United States Patent [19]

Nakai et al.

[11] Patent Number: 4,914,779

[45] Date of Patent: Apr. 10, 1990

[54] AUTOMOTIVE OUTER DOOR OPERATING MEMBER

[75] Inventors: Masakazu Nakai; Naotoshi Inamura, both of Shizuoka, Japan

[73] Assignee: Polyplastics Co., Ltd., Osaka, Japan

[21] Appl. No.: 248,840

[22] Filed: Sep. 26, 1988

[30] Foreign Application Priority Data

Oct. 9, 1987 [JP] Japan ..... 62-255916

[51] Int. Cl.[4] ..... E05B 3/00

[52] U.S. Cl. ..... 16/124; 292/336.3; 292/DIG. 31

[58] Field of Search ..... 16/124, 126, DIG. 30; 292/336.3, DIG. 31, DIG. 23

[56] References Cited

U.S. PATENT DOCUMENTS

| | | | |
|---|---|---|---|
| 4,412,696 | 11/1983 | Ishii et al. | 292/336.3 |
| 4,580,822 | 4/1986 | Fukumoto | 292/336.3 |
| 4,588,219 | 5/1986 | Kobayashi et al. | 292/336.3 |
| 4,634,161 | 1/1987 | Fukasawa et al. | 292/336.3 |
| 4,681,357 | 7/1987 | Uemura et al. | 16/124 |
| 4,805,263 | 2/1989 | Kurtz | 16/124 |

*Primary Examiner*—Nicholas P. Godici
*Assistant Examiner*—Edward A. Brown
*Attorney, Agent, or Firm*—Nixon & Vanderhye

[57] ABSTRACT

An automotive outer door operating member is integrally formed of a thermoplastic resin and comprises a handle and arms extending from the handle; characterized in that the thickness ratio of the root of each arm to the handle at the junctions of the arms and the handle is 0.5 or below.

10 Claims, 1 Drawing Sheet

FIG. 1
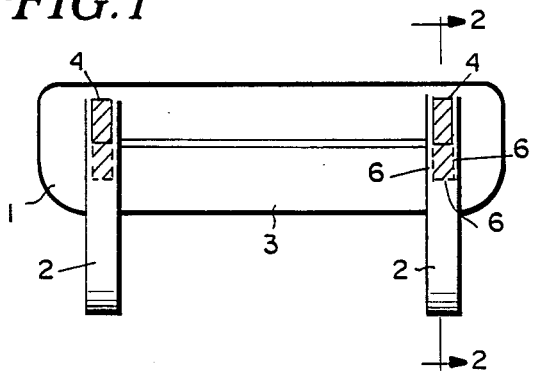
FIG. 2
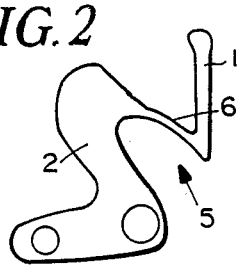
FIG. 3
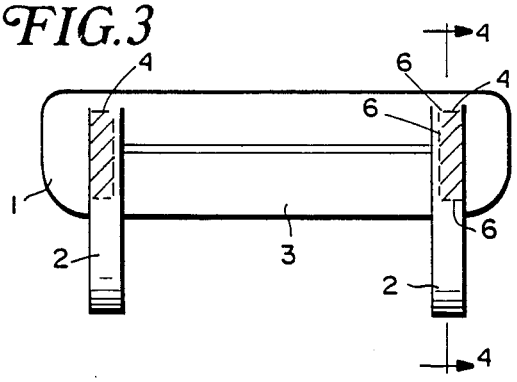
FIG. 4
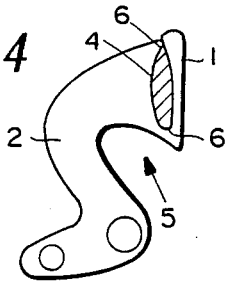
FIG. 5
(PRIOR ART)
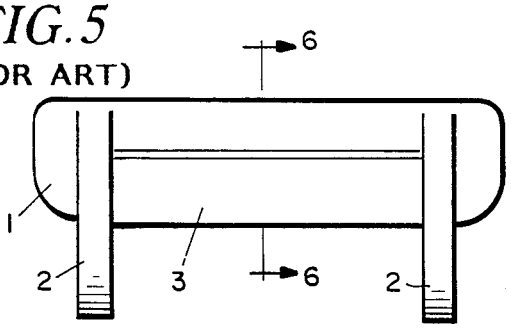
FIG. 6
(PRIOR ART)
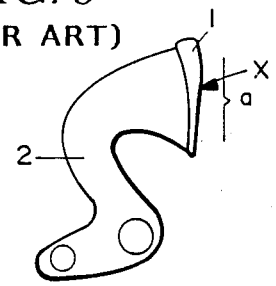
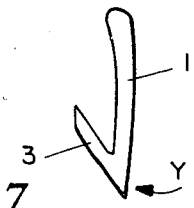
FIG. 7
(PRIOR ART)
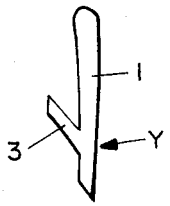
FIG. 8

AUTOMOTIVE OUTER DOOR OPERATING MEMBER

FIELD OF THE INVENTION

The present invention relates to an automotive outer door operating member comprising a handle and arms integrally formed of a thermoplastic resin.

BACKGROUND OF THE INVENTION

An automotive outer door operating member is required to satisfy both functional and aesthetic requirements.

Most conventional automotive outer door operating members have been die-cast zinc members or pressed metallic plate members. However, recent demand for the weight reduction of automobiles has urged the use of resins such as polyacetal, polybutylene terephthalate and polycarbonate for forming outer door operating members.

The use of a resin for forming an automotive outer door operating member advantageously allows for the possibility of integrally forming the handle and the arms, the possibility of economically manufacturing automotive outer door operating members through an injection molding process, the possibility of producing colored automotive outer door operating members by using a colored resin, and the possibility of optionally decorating automotive outer door operating members after molding by plating or painting.

However, since the arms of such an integral automotive outer door operating member extends from the backside of the handle, shrinkage recesses are formed in the surface of the handle at positions corresponding respectively to the junctions of the handle and the arms. Thus, the appearance of the handle is poor which, consequently, reduces the commercial value of the automotive outer door operating member. Accordingly, improved resin automotive outer door operating member is desired in order to eliminate such drawback.

BRIEF DESCRIPTION OF THE DRAWINGS

FIG. 1 is a rear elevation of an outer door operating member representing a preferred embodiment of the present invention;

FIG. 2 is a cross-sectional view taken along section line B—B' in FIG. 1;

FIG. 3 is a rear elevation view of an outer door operating member in another embodiment of the present invention;

FIG. 4 is a cross-sectional view taken along section line C—C' in FIG. 3;

FIG. 5 is a rear elevation view of a conventional automotive outer door operating member;

FIG. 6 is a side elevation view of the automotive outer door operating member of FIG. 5;

FIG. 7 is a cross-sectional view taken along section line A—A' in FIG. 5; and FIG. 8 is a schematic sectional view of an automotive outer door operating member having a back cover joined to a handle at a position a distance from the lower edge of the handle.

The reference numbers of the figures correspond to the following parts:

1: Handle
2: Arm
3: Back cover

4: Recessed portion
5: Root of arm
6: Sidewall

SUMMARY OF THE INVENTION

The present invention is directed toward a solution to the above-identified problems and, thus, provides a door operating member with high strength and no outer surface defects.

An automotive outer door operating member according to the present invention is an integral member formed of a thermoplastic resin, comprising a handle and arms, characterized in that the thickness ratio of the root of each arm to that of the handle at the junctions of the arms and the handle is 0.5 or less.

The thickness ratio specified by the present invention is the thickness ratio of the root of each arm to the handle at the junctions of the arms and the handle. The present invention does not place any restriction on the thickness ratio for other portions of the arms and the handle. Moreover, the thickness of the portions around the root of the arms and the thickness of the corresponding portions of the handle need not be uniform over the entire portions, and the thickness of the root of the arms and that of the corresponding portions of the handle may vary partially according to specific objectives. Essentially, it is required that the ratio of the average thickness of the root of each arm to that of the corresponding portion of the handle is 0.5 or less.

An automotive outer door operating member embodying the present invention will be described hereinafter with reference to the accompanying drawings and in comparison with the conventional automotive outer door operating member.

FIGS. 5–7 show a conventional outer door operating member. FIG. 5 is a rear elevation view of the outer door operating member; FIG. 6 is a side elevation view of the outer door operating member of FIG. 5; and FIG. 7 is a cross-sectional view taken along section line A—A' in FIG. 5. In FIGS. 5–7, 1 is a handle, 2 are arms, and 3 is a back cover extending from the lower edge of the handle 1. FIG. 8 shows another outer door operating member, in which a back cover 3 extends from an inner part of a handle 1.

In this outer door operating member, shrinkage recesses develop in the outer surface of the handle 1 at positions indicated by X in FIG. 6 corresponding to the junctions of the handle 1 and the arms 2.

According to the present invention, the thickness ratio of the root of the arms to the handle at positions corresponding to the junctions of the handle and the arms is substantially 0.5 or less. This design prevents the development of shrinkage recesses in the outer surface of the handle at positions corresponding to the junctions of the handle and the arms. When the thickness ratio is greater than 0.5, it is impossible to prevent the development of shrinkage recesses—which are unacceptable due to the resulting poor appearance. Preferably, the thickness ratio is 0.4 or less and, more preferably, 0.3 or less.

The present invention does not place any particular restriction on the method of forming an outer door operating member as long as it meets the requirement of the thickness ratio of the arms to the handle. For example, the arm of an outer door operating member may be formed into a narrow thickness so that the thickness ratio of the outer door operating member falls in the range of thickness ratio specified by the present invention. However, since the arms are required to have considerable strength, and in most conventional outer door operating members the arms are considerably thick as compared with the handle, it is preferable—in view of preventing shrinkage recesses and maintaining the strength and integrity of the outer door operating member—to reduce the thickness of the arms only in an appropriate part of the root of each arm so that the thickness ratio of the outer door operating member falls in the range of thickness ratio specified by the present invention.

FIGS. 1 and 2 show an automotive outer door operating member embodying the present invention. FIG. 1 is a schematic rear elevation view of the outer door operating member, and FIG. 2 is a cross-sectional view taken along section line B—B' in FIG. 1. In this outer door operating member, a shaded portion 4 of each arm 2 is formed as a hollow construction, which may be a recess defined by at least one sidewall, to reduce the thickness of the root thereof.

In a portion of the outer surface of a handle corresponding to the junction of the handle and the arm, a conspicuous shrinkage recess is liable to develop in the middle portion of the handle between the upper and lower edges of the handle, for example, in a portion indicated at a in FIG. 6. Therefore, the thickness of the entire part of the root of the arm need not be reduced. As shown in FIGS. 3 and 4, which details another embodiment of the present invention, it is possible and effective to reduce the thickness of only a portion of the root of the arm corresponding to the portion of the outer surface of the handle in which a conspicuous shrinkage recess is liable to develop. FIG. 3 is a schematic rear elevation of an outer door operating member, and FIG. 4 is a schematic cross-sectional view taken along section line C—C' in FIG. 3. In FIGS. 3 and 4, a shaded portion 4 of the arm is recessed to reduce the thickness of the root of the arm. The recess 4 of the root portion 5 of the arm is defined by at least one sidewall 6, which integrally connects with the handle, and a corresponding portion of the handle.

As mentioned above, the root of the arm need not be uniformly reduced in thickness. The thickness of the root of the arm may optionally be varied as desired from portion to portion. Essentially, the root of the arm may be formed in any design as long as the average thickness ratio is 0.5 or less.

According to the present invention, the thickness ratio may be a value greater than zero. However, in view of the strength requirements of the junctions of the arms and the handle, the thickness ratio is preferably 0.05 or above, and, more preferably, 0.1 or above.

Shrinkage recesses develop in the outer surface of the handle 1 in a portion corresponding to the junction of the back cover 3 and the handle 1 (portions indicated at Y in FIGS. 7 and 8). Such recesses can especially occur when the junction of the back cover 3 and the handle 1 is located at a distance from the edge (the lower edge in FIG. 8) of the handle 1 as shown in FIG. 8. In this case also, the development of shrinkage recesses can effectively be prevented by forming the root of the back cover in a thickness so that the thickness ratio of the root of the back cover to the handle is 0.5 or less.

Thus, the present invention is characterized by the morphology of the outer door operating member and places no restriction on the resin for forming the outer door operating member. However, in view of the requisite physical properties of the outer door operating member, preferable resins for forming the outer door operating member are polyacetal resin, polybutylene terephthalate resin, polycarbonate resin and the like.

The present invention will be described in detail hereinafter with reference to examples thereof. However, the present invention is not limited in its application to these examples specifically described herein.

EXAMPLES 1 TO 15 AND CONTROLS 1 TO 7

Outer door operating members were formed from different resins as shown in Table 1 by molding the members in different thickness ratios (thickness ratios of the root of the arm to the corresponding portion of the handle, and thickness ratios of the root of the back cover to the corresponding portion of the handle) as shown in Table 1 in a morphology as shown in FIGS. 1 and 2, and a morphology as shown in FIG. 8. The various resins used for forming the outer door operating members were a polyacetal resin, a polybutylene terephthalate resin and a polycarbonate resin. The thickness of the handles was 4 mm, which is the thickness of the handles of typical outer door operating members. The thickness of the arms which were not recessed was 7 mm, in which the thickness ratio being 1.75.

The absolute sizes of shrinkage recesses formed in the outer surface of the handle of each outer door operating member thus formed by molding in portions corresponding to the junctions of the arms and the handle and in a portion corresponding to the junction of the back cover and the handle, and the condition of the shrinkage recesses was evaluated through visual observation. The measurement and observation results are tabulated in Table 1.

TABLE 1

| | | | Results | | | |
|---|---|---|---|---|---|---|
| | | | Junction of arms and handle | | Junction of back cover and handle | |
| | Material | Thickness ratio | Size of shrinkage recess (μm) | Appearance*1 | Size of shrinkage recess (μm) | Appearance*1 |
| Example 1 | Polyacetal resin | 0.50 | 5 | ○ | 4 | ○ |
| Example 2 | (DURACON M90-35) | 0.30 | 2 | ◎ | 1 | ◎ |
| Example 3 | | 0.20 | 0 | ◎ | 0 | ◎ |
| Control 1 | | 1.75 | 81 | xx | 75 | xx |
| Control 2 | | 0.75 | 21 | x | 19 | x |
| Example 4 | Polyacetal resin | 0.50 | 3 | ◎ | 3 | ◎ |
| Example 5 | (DURACON MP-01) | 0.30 | 1 | ◎ | 1 | ◎ |
| Example 6 | | 0.20 | 0 | ◎ | 0 | ◎ |
| Control 3 | | 0.75 | 12 | Δ | 13 | Δ |
| Example 7 | Polybutylene | 0.50 | 2 | ◎ | 2 | ◎ |
| Example 8 | terephthalate resin | 0.30 | 0 | ◎ | 1 | ◎ |
| Example 9 | (DURANEX 2002) | 0.20 | 0 | ◎ | 0 | ◎ |
| Control 4 | | 0.75 | 9 | Δ | 9 | Δ |

TABLE 1-continued

| | Material | Thickness ratio | Results: Junction of arms and handle: Size of shrinkage recess (μm) | Junction of arms and handle: Appearance*[1] | Junction of back cover and handle: Size of shrinkage recess (μm) | Junction of back cover and handle: Appearance*[1] |
|---|---|---|---|---|---|---|
| Example 10 | Polybutylene | 0.50 | 5 | ○ | 5 | ○ |
| Example 11 | terephthalate resin | 0.30 | 3 | ◎ | 2 | ◎ |
| Example 12 | (DURANEX 3300) | 0.20 | 2 | ◎ | 0 | ◎ |
| Control 5 | | 1.75 | 72 | xx | 69 | xx |
| Control 6 | | 0.75 | 17 | x | 17 | x |
| Example 13 | Polycarbonate resin | 0.50 | 2 | ◎ | 3 | ◎ |
| Example 14 | (Iupilon S-1000) | 0.30 | 0 | ◎ | 0 | ◎ |
| Example 15 | | 0.20 | 0 | ◎ | 0 | ◎ |
| Control 7 | | 0.75 | 8 | Δ | 9 | Δ |

*[1]◎Excellent. No shrinkage recess
○Fairly good. Practically acceptable shrinkage recesses
Δ Bad. Conspicuous, practically questionable shrinkage recesses
x and xx Very bad. Large or deep, practically rejectable shrinkage recesses A reasonably acceptable size of shrinkage recess is on the order of 5 μm or less and, preferably, 3 μm or less. As is obvious from Table 1, the thickness ratio must be 0.5 or less and, preferably, 0.3 or less to prevent the development of shrinkage recesses having a size exceeding the foregoing acceptable size.

EFFECT OF THE INVENTION

According to the present invention and as is apparent from the foregoing description and the examples, an automotive outer door operating member is intergrally formed from a resin so that the thickness ratio at the junction of the arms and handle thereof and, when desired, the thickness ratio at the junction of the back cover and handle thereof are 0.5 or less, which, in turn, suppresses the development of shrinkage recesses in the outer surface of the handle to a reasonably acceptable extent and results an automotive outer door operating member having a satisfactory appearance and a high commercial value.

Furthermore, the automotive outer door operating member can be formed more economically by using a thermoplastic resin in an injection molding process, and the molded automotive outer door operating member can in a relatively easy manner be decorated by coloring, plating or painting.

What is claimed is:

1. An automotive outer door operating member integrally formed of a thermoplastic resin comprising:

a handle, arms extending from the handle, each arm having a root portion connecting said arm to said handle, with said root portion having a recess defined by at least one sidewall, which integrally connects with said handle, and a corresponding portion of the handle, wherein the thickness ratio of the sidewall of each arm to that of the handle at the junction of each arm and the handle is 0.5 or less.

2. An automotive outer door operating member as claimed in claim 1, in which the thickness ratio is between 0.05 and 0.5.

3. An automotive outer door operating member as claimed in claim 1, wherein the resin is polyacetal.

4. An automotive outer door operating member as claimed in claim 1, wherein the resin is polybutylene phthalate.

5. An automotive outer door operating member as claimed in claim 1, wherein the resin is polycarbonate.

6. An automotive outer door operating member integrally formed of a thermoplastic resin comprising:

a handle, arms extending from the handle, each arm having a root portion connecting said arm to said handle, with said root portion having a recess defined by at least three sidewalls, which integrally connect with said handle, and a corresponding portion of the handle, wherein the thickness ratio of the root portion of each arm to that of the handle at the junction of each arm and the handle is 0.5 or less.

7. An automotive outer door operating member as claimed in claim 6, in which the thickness ratio is between 0.05 and 0.5.

8. An automotive outer door operating member as claimed in claim 6, wherein the resin is polyacetal.

9. An automotive outer door operating member as claimed in claim 6, wherein the resin is polybutylene phthalate.

10. An automotive outer door operating member as claimed in claim 6, wherein the resin is polycarbonate.

* * * * *

UNITED STATES PATENT AND TRADEMARK OFFICE

CERTIFICATE OF CORRECTION

PATENT NO. : 4,914,779

DATED : April 10, 1990

INVENTOR(S) : Masakazu NAKAI, et al

It is certified that error appears in the above-identified patent and that said Letters Patent is hereby corrected as shown below:

IN THE DRAWINGS:

In FIG. 5, please change the vertical section line references which read "6" to --7--, so that the section line references correctly refer to FIG. 7 and not FIG. 6.

Column 1, line 39, after "Accordingly," insert --an--.

Column 1, line 48, change "B—B'" to --2-2--.

Column 1, line 53, change "C—C'" to --4-4--.

Column 1, line 59, change "A—A'" to --7-7--.

Column 2, line 40, change "A—A'" to --7-7--.

Column 3, line 16, change "B—B'" to --2-2--.

Column 3, line 28, change "details" to read --detail--.

Column 3, line 36, change "C—C'" to --4-4--.

Column 4, line 42, delete "in which" and insert --with--.

UNITED STATES PATENT AND TRADEMARK OFFICE

CERTIFICATE OF CORRECTION

PATENT NO. : 4,914,779

DATED : April 10, 1990

INVENTOR(S) : Masakazu NAKAI, et al

It is certified that error appears in the above-identified patent and that said Letters Patent is hereby corrected as shown below:

Below columns 3 and 4, in Table 1, under the column heading of "Material":

immediately to the right of "Example 3" insert --ditto--;
immediately to the right of "Control 1" insert --ditto--;
immediately to the right of "Control 2" insert --ditto--;
immediately to the right of "Example 6" insert --ditto--;
immediately to the right of "Control 3" insert --ditto--;
immediately to the right of "Control 4" insert --ditto--.

At the top of columns 5 and 6, in Table 1-continued, under the column heading of "Material":

immediately to the right of "Control 5" insert --ditto--;
immediately to the right of "Control 6" insert --ditto--;
immediately to the right of "Example 15" insert --ditto--;
immediately to the right of "Control 7" insert --ditto--.

Column 5, line 29, change "intergrally" to read --integrally--.

UNITED STATES PATENT AND TRADEMARK OFFICE

CERTIFICATE OF CORRECTION

PATENT NO. : 4,914,779

DATED : April 10, 1990

INVENTOR(S) : Masakazu Nakai, et al

It is certified that error appears in the above-identified patent and that said Letters Patent is hereby corrected as shown below:

Column 5, line 36, after "results" insert --in--.

Signed and Sealed this

Twenty-third Day of April, 1991

*Attest:*

HARRY F. MANBECK, JR.

*Attesting Officer*

*Commissioner of Patents and Trademarks*